US008109413B2

(12) United States Patent
Schroeder et al.

(10) Patent No.: US 8,109,413 B2
(45) Date of Patent: Feb. 7, 2012

(54) SUPPLY LINE CONNECTOR FOR A BAR GUN ASSEMBLY

(76) Inventors: A. A. Jud Schroeder, San Antonio, TX (US); Dave Santy, Converse, TX (US)

( * ) Notice: Subject to any disclaimer, the term of this patent is extended or adjusted under 35 U.S.C. 154(b) by 789 days.

(21) Appl. No.: 12/286,441

(22) Filed: Sep. 30, 2008

(65) Prior Publication Data

US 2009/0084817 A1 Apr. 2, 2009

Related U.S. Application Data

(60) Provisional application No. 60/997,070, filed on Oct. 1, 2007, provisional application No. 61/128,719, filed on May 23, 2008.

(51) Int. Cl.
*B67D 7/06* (2010.01)

(52) U.S. Cl. ..... 222/145.5; 222/129.1

(58) Field of Classification Search ..... 222/144.5, 222/145.1, 145.5, 192.1, 192.2, 630, 129.1, 222/129.2; 137/605–607, 884
See application file for complete search history.

(56) References Cited

U.S. PATENT DOCUMENTS

| | | | |
|---|---|---|---|
| 1,627,147 | A | 5/1927 | Clark |
| 1,947,329 | A | 2/1934 | Buttner |
| 2,478,586 | A | 8/1949 | Krapp |
| 2,682,386 | A | 6/1954 | Lindsay |
| 2,887,250 | A | 5/1959 | Zilk |
| 2,937,792 | A | 5/1960 | Firstenberg |
| 3,009,653 | A | 11/1961 | Hedeman |
| 3,013,701 | A | 12/1961 | Joschko |
| 3,108,779 | A | 10/1963 | Anderson |
| 3,326,520 | A | 6/1967 | Guenther |
| 3,619,668 | A | 11/1971 | Pinckaers |
| 3,643,754 | A | 2/1972 | Brandin et al. |
| 3,867,962 | A | 2/1975 | Gerrard |
| 3,963,317 | A | 6/1976 | Eignbrode et al. |
| 4,098,295 | A | 7/1978 | Haytayan |
| 4,196,886 | A | 4/1980 | Murray |
| 4,219,046 | A | 8/1980 | West et al. |
| 4,390,224 | A | 6/1983 | Showman et al. |
| 4,433,795 | A | 2/1984 | Maiefski et al. |
| 4,469,389 | A | 9/1984 | Grabbe et al. |
| 4,497,421 | A | 2/1985 | Schilling |
| 4,519,635 | A | 5/1985 | McMath |
| 4,619,378 | A | 10/1986 | de Man |
| 4,635,824 | A | 1/1987 | Gaunt et al. |
| 4,637,527 | A | 1/1987 | Arrigoni |
| 4,711,374 | A | 12/1987 | Gaunt et al. |
| 4,821,921 | A | 4/1989 | Cartwright et al. |
| 4,921,140 | A | 5/1990 | Belcham |
| D309,232 | S | 7/1990 | Valiyee et al. |
| 4,986,449 | A | 1/1991 | Valiyee et al. |
| 5,033,648 | A | 7/1991 | Nakayama et al. |

(Continued)

FOREIGN PATENT DOCUMENTS

| | | |
|---|---|---|
| GB | 1 300 072 | 12/1972 |
| GB | 2 042 354 | 9/1980 |

*Primary Examiner* — Lien Ngo

(57) ABSTRACT

A bar gun assembly for receiving a multiplicity of fluid carrying tubes carrying a multiplicity of fluids, for example, flavored syrup and soda water, therein. The bar gun assembly has a handle having a handle body. The handle body is a multiplicity of ports and fluid channels therein. A supply line connector assembly engages the supply lines and the handle body. A backing plate assembly engages openings in the fluid chambers of the handle body to seal fluid therein. A nozzle assembly engages at least some of the fluid channels in the handle.

6 Claims, 16 Drawing Sheets

U.S. PATENT DOCUMENTS

| | | | | |
|---|---|---|---|---|
| 5,042,692 | A | 8/1991 | Valiyee et al. | |
| 5,524,452 | A | 6/1996 | Hassell et al. | |
| 5,649,431 | A | 7/1997 | Schroeder, Jr. | |
| 5,873,259 | A | 2/1999 | Spillman | |
| 6,322,051 | B1 | 11/2001 | Salmela | |
| 6,328,181 | B1 | 12/2001 | Schroeder et al. | |
| 7,866,509 | B2 * | 1/2011 | Ziesel | 222/145.1 |

* cited by examiner 10
235a 235
326
300

200
100

SECTION A-A

SUPPLY LINE CONNECTOR FOR A BAR GUN ASSEMBLY

This application claims the benefit of and priority from U.S. Patent Application Ser. No. 60/997,070, filed Oct. 1, 2007; and U.S. Patent Application Ser. No. 61/128,719, filed May 23, 2008.

FIELD OF THE INVENTION

Bar gun assemblies, including a bar gun having a novel fluid supply line connector assembly, a novel backing plate, and a novel nozzle assembly.

BACKGROUND

Bar gun assemblies are used to selectively receive a multiplicity of different flavored syrups from a multiplicity of pressurized sources and to mix the syrup with soda water and dispense the resulting beverage into a container.

OBJECT OF THE INVENTION

An improved bar gun assembly for the convenient, effective dispensing of a beverage therefrom.

SUMMARY OF THE INVENTION

Applicants' bar gun provides certain structural and functional advantages, including those related to a novel nozzle assembly, novel handle, and a novel heel, tube and connector plate.

Regarding Applicants' novel nozzle assembly, structure is provided that ensures full coverage of the soda water around inner walls of a nozzle housing, which full coverage of water helps prevent flavor carryover. Flavor carryover may occur on certain prior art nozzles when a syrup of a previously dispensed drink, especially one with a pungent flavor, gets carried over into a subsequently dispensed drink.

Applicants provide a novel nozzle assembly, including a nozzle, a core structure, and a nozzle housing, which may include a nose, for substantially enclosing the core except at the outlet thereof, which nozzle housing along with the nozzle core structure provides a full coverage of soda water flow coating the inner walls of the nozzle housing with soda water before the soda water is exposed to any syrup.

Applicants' novel nozzle assembly further provides structure in a novel spray head. The spray head is typically part of the core and located at the removed end of the core. It is sectored into multiple pie-shaped sectors, each for receiving a different syrup. Each sector is slated and of an area slightly less than a fluid carrying channel engaged therewith. It distributes syrup, under pressure, in a directed manner. The direction of the pressurized syrup in a spray pattern, rather than a column patter, is outward towards an inwardly directing nozzle housing nose. As set forth in the paragraph above, however, the nose is coated completely with soda water, so the outwardly directed syrup strikes the water to form a diluted soda water syrup mix (the beverage), before the mix is ejected from the nose opening of the nozzle housing.

The elements of the nozzle set forth in the paragraph above work in conjunction with a controlled pressure flow of soda water as it reaches the nose of the nozzle, which pressure flow control is passive. Soda water flow is controlled through the dimensioning of the device without active moving valves, and allows for much of the foaming of the soda water to occur at or near the point where the syrup and soda mix (that is, the inner walls of the nose of the nozzle housing).

More specifically, Applicants' novel nozzle design allows a controlled and stayed pressure release through the use of a diverter plate and diverter channels downstream of the initial point of release of soda water into the nozzle, which helps with back pressure and helps with avoiding excessive foaming. Moreover, controlled core to inner housing annulus dimensions prevent a too sudden release of pressure. Rather, Applicants provide for much of the foaming generated by pressure release to occur at a point near the terminus of an annulus between the nozzle core and the inner walls of the nozzle housing, near where the nose section of the nozzle begins and/or just shortly before the point of being struck by the syrup.

Applicants' novel nozzle assembly further provides break resistance in a twist-proof coupling of the nozzle core to the handle. This is achieved through the use of lips extending from the upper surface of the nozzle core into recesses dimensioned to receive the same in the head of the handle.

Applicants also provide a fluid tight couple of the nozzle housing to the handle through the use of an elastomeric seal, such as a face seal or O ring, slotted into a groove in the handle and an engagement member on the nozzle core that allows engagement to the nozzle in a twisting manner. The twisting will urge the upper end of the nozzle housing against the elastomeric member to help ensure fluid tight couple.

The nozzle core is adapted to receive both pressurized soda water and syrup from the handle and direct the pressurized soda water against the inner walls of the outer nozzle housing well above the point that the syrup strikes the soda water coated nozzle housing inner walls. This provides for a soda water rinse of the mix zone when the handle operator releases the fluid delivery buttons.

The handle also has a number of novel features, including a base, the base including structure designed to engage simultaneously a multiplicity of springs for fluid tight coupling to a base. An efficient and easy base structure is provided such that a multiplicity of individual springs, seated in the handle, can be engaged to the base simultaneously with one structure.

The one-piece unitary structure of the base includes a multiplicity of spring engaging or retaining bodies and structure which will help align the multiplicity of retainers on the base with the handle and the springs while the plate is being assembled and disassembled to the handle.

The heel of the handle includes means for efficient coupling of the handle to an assembly comprising a multiplicity of fluid lines. That is to say, Applicants provide an assembly for use of the heel of the handle for engagement of a multiplicity of fluid lines, typically coming from a manifold assembly to fluidly seal in a fluid tight manner to the heel of the bar gun.

At the heel of the handle, a coupling is provided that includes a connector and a ferrule with a resilient fluid supply line captured between the pressed on ferrule and the connector. The connector typically includes a pair of O-rings and a nose that includes a barb. The ferrule is pressed on the portion of the connector, including the portion adjacent the barb, which helps prevent pull-out of the fluid line between the ferrule and the connector when the connector is engaged in a fluid tight manner to the block. Moreover, the plate is provided for blockingly engaging the ferrule, but dimensioned to allow the fluid line to pass through, which plate will effectively hold a multiplicity of fluid line connector couplings to the heel to remain engaged therewith.

An improved bar gun assembly comprising a novel supply line connector assembly, a novel backing plate assembly, and a novel nozzle assembly.

BRIEF DESCRIPTION OF THE DRAWINGS

FIG. 5A is an exploded perspective looking from the top of the nozzle towards the nose, and FIG. 5B is an exploded perspective looking from the nose up towards the top of the nozzle.

FIG. 5C illustrates the manner in which Applicants' novel nozzle core engages the handle through gluing, with projecting lips on the core seated into recesses on the handle. Applicants' nozzle housing then engages the nozzle core in a twisting manner, which twisting manner urges the upper rim of the nozzle housing into the upper rim of the nozzle housing against an O-ring seated in the handle.

DETAILED DESCRIPTION OF THE PREFERRED EMBODIMENTS

Figure 1A:
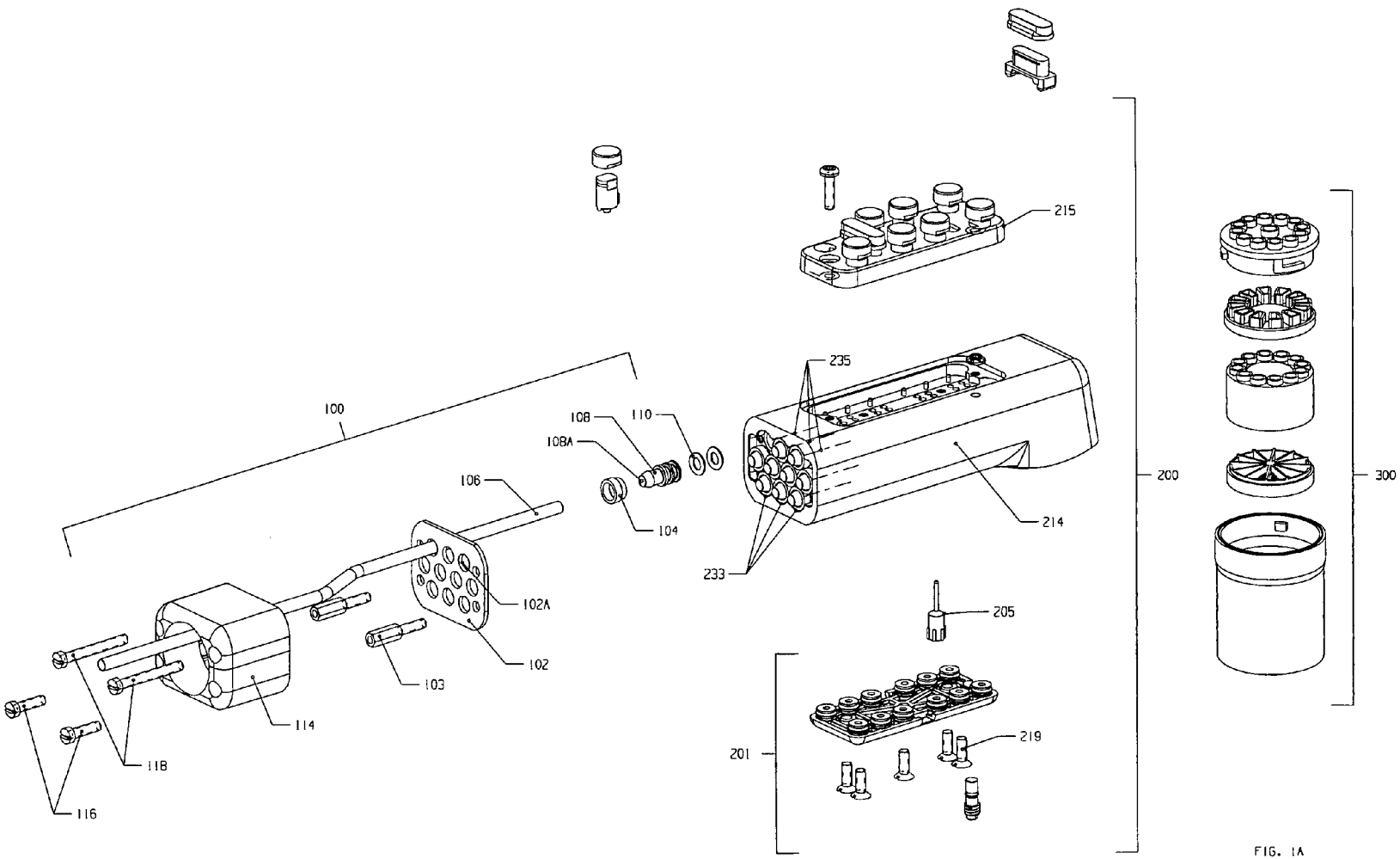
FIG. 1A is an exploded perspective view of a novel bar gun assembly, with the embodiment of the nozzle assembly described in FIGS. 4A-4H.
Figures 1L, 1T:
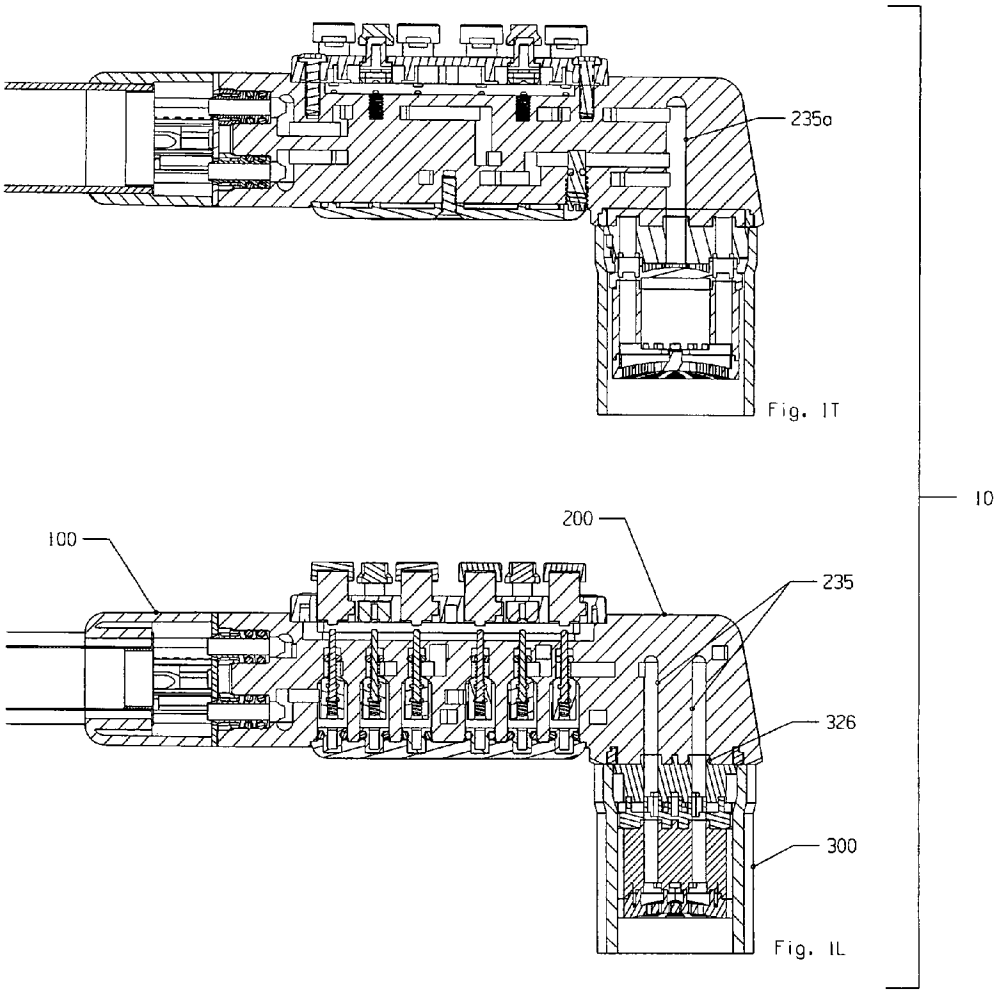
FIG. 1L is a side sectional view of the bar gun assembly spaced apart from, but parallel to, the view of FIG. 1T, through the centerline of the buttons.
FIG. 1T is a side sectional view of a novel bar gun assembly taken bilaterally with respect to the longitudinal axis of the handle, through the centerline of the handle.

The bar gun assembly 10 in FIGS. 1T, 1L, and 1A is seen to comprise three sub-assemblies, supply lines connector assembly 100, handle portion assembly 200, including at least handle body 214 and button assembly 215, including a backing plate assembly 201, and nozzle assembly 300. One function of the bar gun assembly 10 is to transport pressurized fluids from multiple sources upstream of the supply lines connector assembly and dispense fluids, mixed, from the end of the nozzle assembly 300.

More specifically, as seen in FIGS. 1L, 1T, 1A, 2, and 2A, the supply lines connector assembly 100 will include a multiplicity of hoses, lines or tubes 106, each hose carrying syrup from a different fluid source. For example, one hose would bring Coke syrup, another grape syrup, another orange syrup, another root beer, etc. Typically, soda water under pressure is provided also in one of the multiplicity of tubes that are part of the supply lines connector assembly 100 as set forth below.

Supply lines connector assembly 100 will physically locate as a group and maintain the position of the ends of the multiplicity of tubes. One of the tubes may carry water, another soda and the other typically different kinds of syrup. Mixing the syrup with the soda water from the gun assembly into an ice filled cup will provide the desired soft drink. A number of buttons in the handle portion assembly 200 can be depressed. Depending upon the button or buttons depressed, the bartender holding the handle can choose Coke, root beer, orange, etc. for delivery from the nozzle.

Upstream of the bar gun assembly 10 is a multiplicity of pressurized sources (not shown) for the different fluids and they are carried to the bar gun assembly with their ratios already adjusted to the proper ratio mix. For example, Coke may be a 5 to 1 mix, root beer a 4 to 1 mix and orange soda a 6 to 1 mix. Upstream of the bar gun assembly, careful adjustment is made of flow control to properly select the flow at which the different syrup is delivered. Likewise, the flow at which the soda water is delivered is carefully adjusted.

One goal of any soda dispenser, including a bar gun assembly, and structures upstream thereof, is to deliver the liquid at the "perfect ratio control." The ratio of soda water to syrup is desirably obtained and maintained. Thus, for example, a perfect ratio control for Coke syrup to water might be 5 to 1 (soda water/syrup). Straying or movement from that ratio in any material amount would typically cause the drink to taste different, typically either weaker or stronger. Most consumers' taste buds are fairly particular and can taste difference when the proper ratio is altered.

This application discloses a number of novel features. Novel features exist separately in the supply lines connector assembly 100, handle portion assembly 200, and nozzle assembly 300. That is to say, novel features are found in both the separate assemblies and combined, and provide novel efficiencies and advantages heretofore not known to the prior art.

One problem that presently exists in current tubes used for transporting syrup to the supply line connector assembly is the effect of pungent flavors, such as root beer, migrating across the tube to adjacent tubes carrying other flavored syrups. The pungent flavors may taint nearby tubes carrying different flavors and thus affect the taste of the drink.

Applicant has found tubes, typically not as flexible or pliable as the prior art tubes, with properties that help avoid the unwanted flavor transmission across tubes. These tubes have a nylon inner barrier to help prevent unwanted flavor transmission. In an effort, in part, to adapt stiffer tubes, including tubes with nylon inner barriers or other flavor impervious barriers, which are believed to prevent or at least decrease the transmission of pungent flavors, Applicant provides a novel connector assembly, which in one embodiment may include the novel flavor impermeable tubes.

The functions of supply lines connector assembly 100 include providing location and placement for the ends of a multiplicity of tubes onto the rear of the body of the handle assembly in fluid engagement with body ports 233 and body channels 235 therein. That is to say, Applicant provides a handle body 214, typically machined plastic, the handle body having a multiplicity of body channels, including channels 235, and ports 233 therein capable of receiving fluid from a multiplicity of tubes 106 (see FIG. 1A).

Fluids in tubes 106 (one illustrated as FIG. 1A for the sake of simplicity) are carried under pressure and introduced to channels 235 in the body of handle portion assembly 200. Thus, a tube/body seal must be substantially fluid tight. One function of Applicant's novel supply lines connector assembly 100 is to adapt tubes 106, in a fluid, tight, fastened relationship to ports and/or channels in a body of the handle assembly.

Applicant provides a novel nipple assembly 101 having a cylindrical, hollow, typically brass connector nipple 108, with a pair of O-rings 110 engaged therewith. This nipple slides into the end portion of tube 106 and the tube end is compressed between a portion of connector nipple 108 and a tightly pressed-on ferrule 104. Nipple assembly 101, including the end of fluid bearing tube 106, is seen to snugly engage body port 233 of handle body 214 of handle portion assembly 200.

Figure 2:
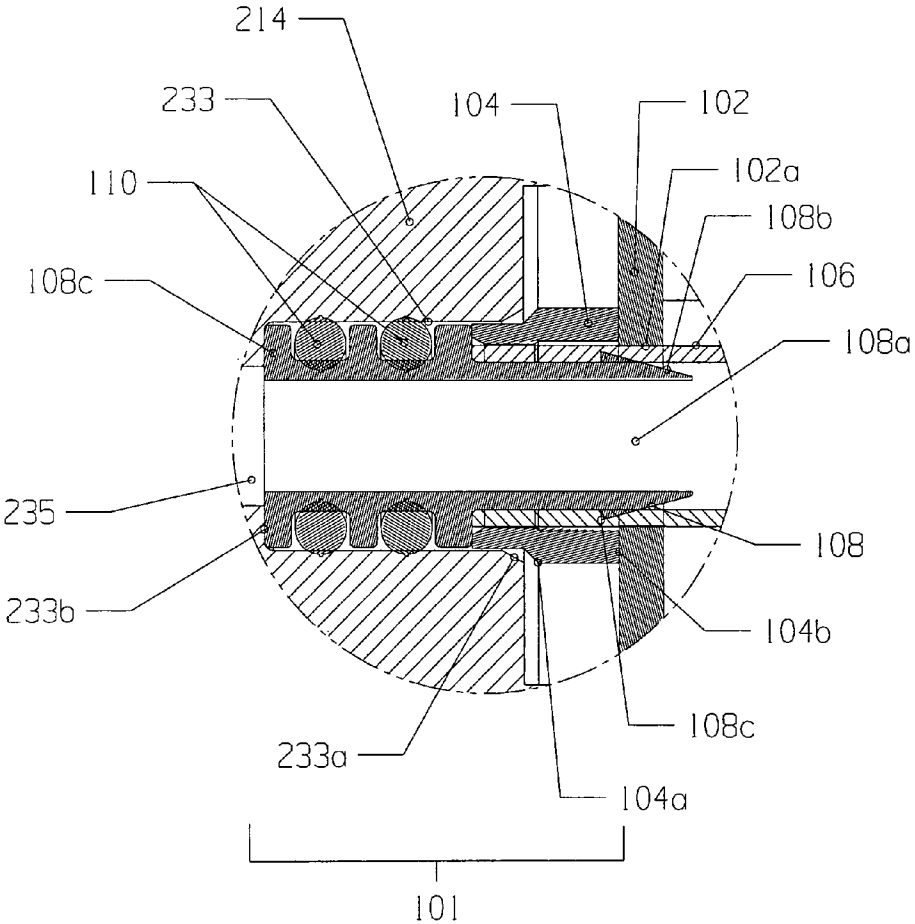
FIG. 2 is a partial cross-sectional elevational view of the connector assembly.
Figure 2A:
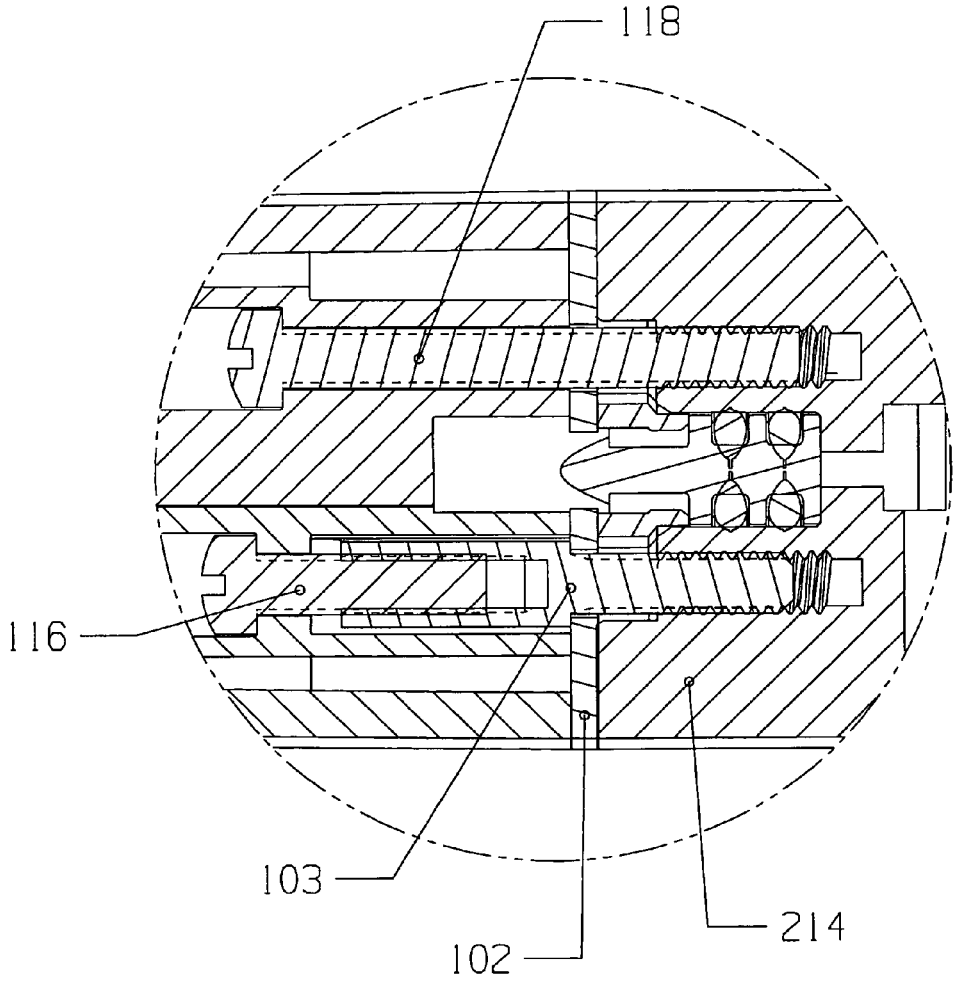
FIG. 2A is a cross-sectional elevational view of the connector assembly.

Turning to FIGS. 2 and 2A, it is seen that nipple assembly 101 contains connector nipple 108, whose functions are several. First, connector nipple 108 is designed to tightly compress tube 106 against inner walls of ferrule 104. Further, connector nipple 108 of nipple assembly 101 is seen to have outer walls dimensioned to engage one or more, here a pair of O-rings 110. Further, connector nipple 108 is seen to provide a nipple channel 108*a* therein to carry fluid under pressure from the tube to the body channel. The diameter of nipple channel 108*a* is close to the inner diameter of the supply lines 50, as to maintain fairly uniform flow rate into the handle body. The diameter of nipple channel 108*a* is also close to that of body channels 235 (see FIG. 2). In one embodiment, the inner diameter of the nipple channel is 0.150", the tube 0.165", and the body channel 0.187".

Nipple assembly 101 will engage a hole 102*a* in connector plate 102. More specifically, it is seen that ferrule 104 is cylindrical and is dimensioned such that ferrule shoulder 104*a* lies close to or joins flush against a port shoulder 233*a* when the end walls 104*b* of the ferrule lay approximately flush with the end walls of handle body 214 substantially abutting inner walls of connector plate 102. With hole 102*a* dimensioned slightly larger than tube, hex standoff and fasteners 103 (see FIG. 2A), tightly engaging retainer plate 102 against the end walls of body 214, retainer plate 102 will "sandwich" and hold in place nipple assembly 101 within body port 233 of body 214. Note in FIG. 2 that nipple end walls 108*c* typically abut body port end walls 233*b* to restrict longitudinal movement of nipple assembly 108. A heel 114 is provided with fasteners 116 that will engage the heel and thread into the heads of hex standoffs 103, two are used in the illustrated embodiment. Heel/main body fasteners 118 engage the heel, go through holes in the connector plate 102 and into threads of handle body 214 "capturing" the connector plate between the heel and the handle body. Thus, if the heel breaks or needs replacement, it can be removed without removing connector plate 102.

Further, it is seen with reference to FIG. 2 that a pair of O-rings 110 of nipple assembly 101 may present a fluid tight fit and seal between walls of body port 233 and the nipple assembly 101. Likewise, the compression fit of tube 106 between ferrule 104 and nose 108*b* of connector nipple 108 will provide fluid tight fit against the tube 106. Barb 108*c* (typically annular) will help prevent inadvertent tube pull out.

The connection illustrated in FIG. 2 is repeated for a multiplicity of body channel/tube connections.

Figure 2B:
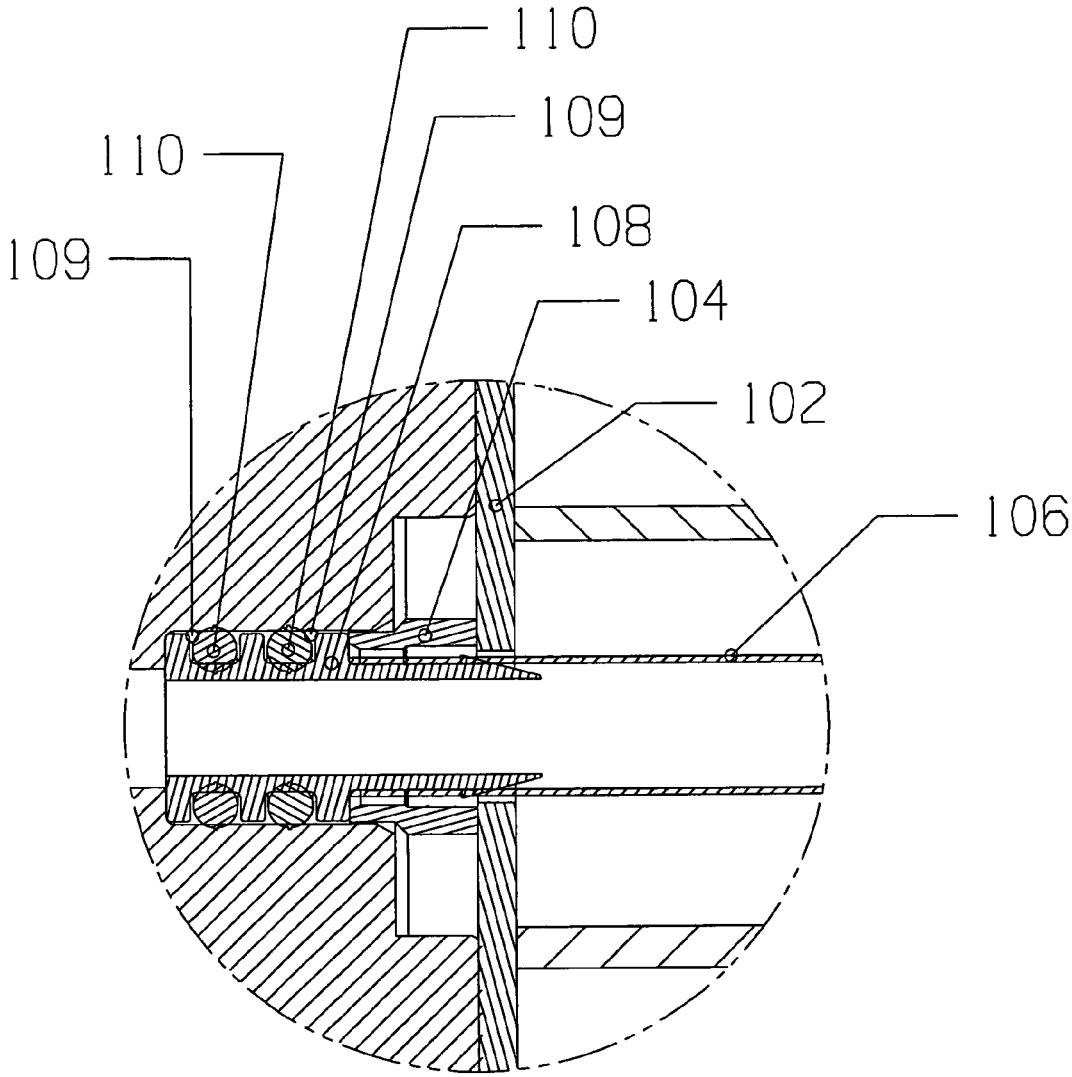
FIG. 2B is a second embodiment of the connector assembly of FIGS. 2 and 2A.

FIG. 2B illustrates that an embodiment of Applicants' supply lines connector assembly 100 typically includes a pair of bays 109 are defined in connector nipple 108 for the location of elastomeric sealing members, such as O-rings 110 thereupon.

Figure 3A:
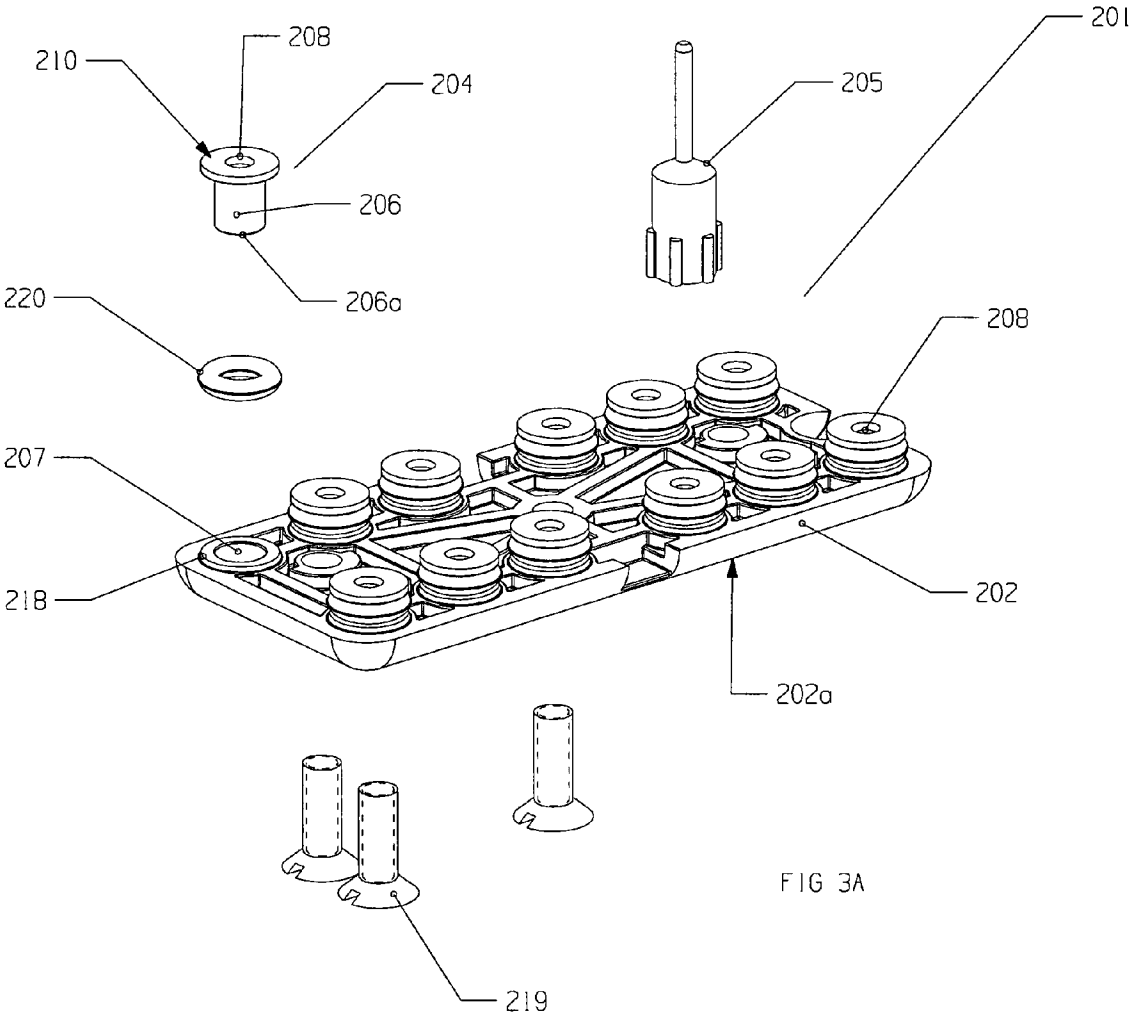
FIGS. 3A and 3B illustrate cross-sectional views of Applicant's backing plate assembly.
Figure 3B:
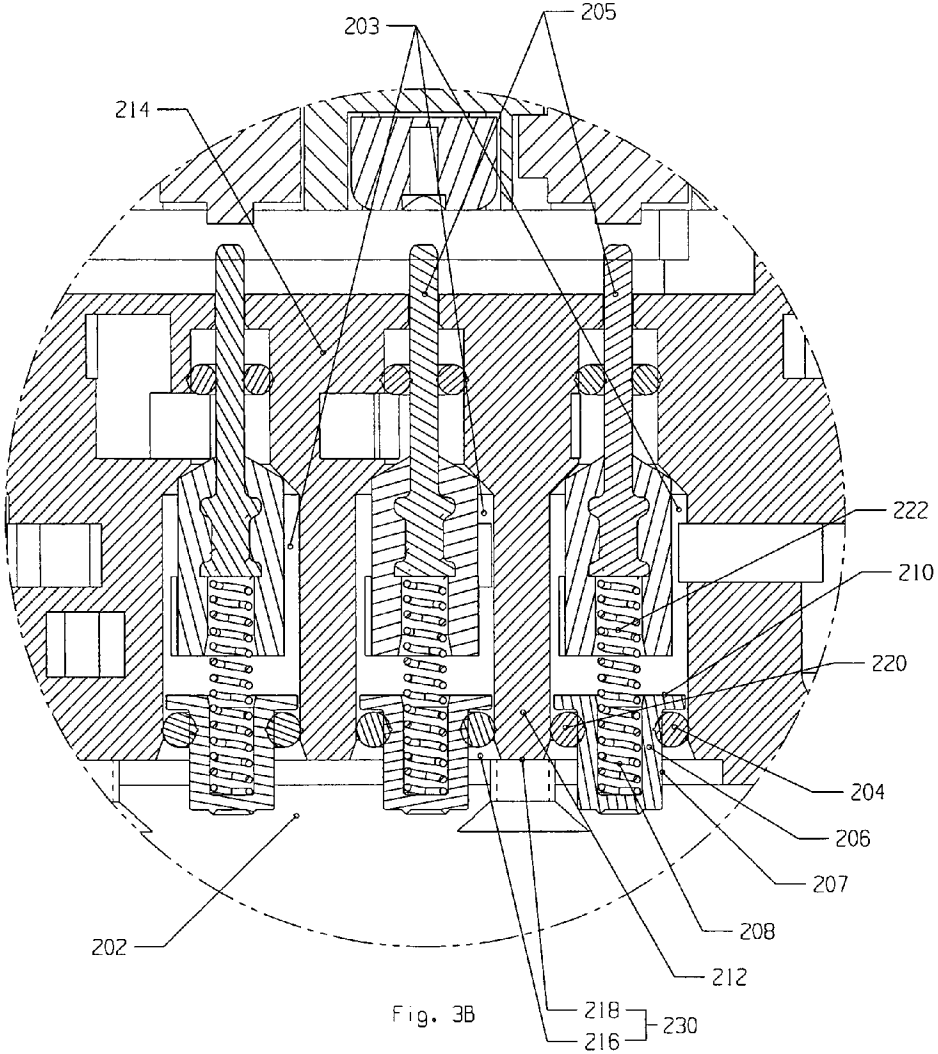
Figure 3C:
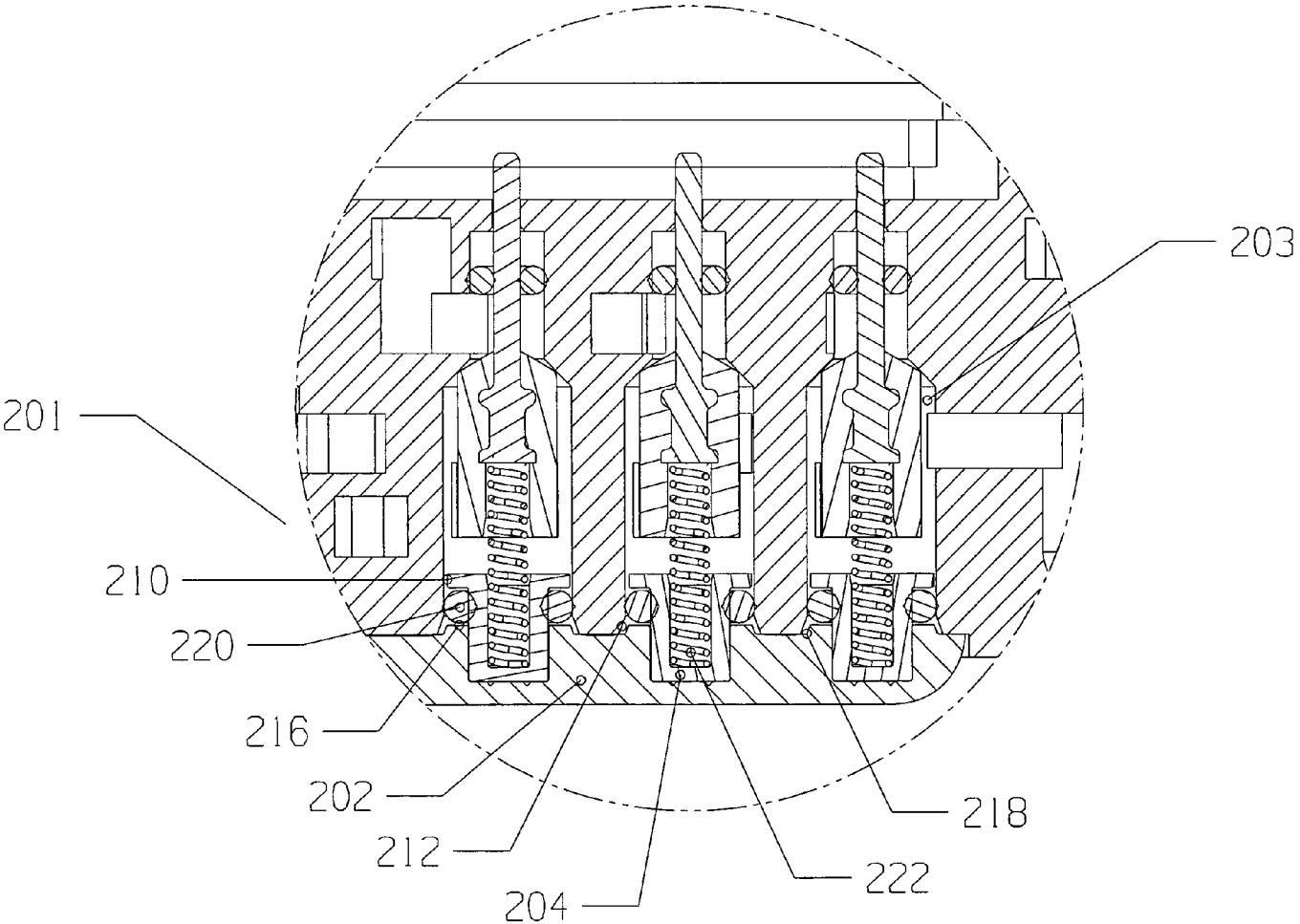
FIG. 3C is the embodiment illustrated in FIG. 3B, but including the base.

FIGS. 3A, 3B, and 3C illustrate a backing plate assembly 201 for use in conjunction with and for engagement with handle body 214 of handle portion assembly 200. The function of backing plate assembly 201 is to provide for convenient, one-piece fluid sealing to a multiplicity of cylindrical chambers 203, which chambers have manually (button) actuated valves 205 which control the flow of fluid therethrough in ways known in the trade. The manner in which backing plate assembly 201 provides for the one-piece fluid sealing and the advantages of such backing plate assembly will be further set forth below.

Backing plate assembly 201 is seen to comprise a base 202, the base having a bottom surface 202*a* and an upper surface that is characterized by a multiplicity of upstanding base engaging retainers 204. The retainers are positioned adjacent locations of cylindrical chambers 203 and are adapted to engage the chambers in fluid sealing relation and to engage elastomeric sealing members, such as O rings. The retainers retain O-rings 220 to base 202 and also engage springs 222. It is seen that retainers 204 comprise a retainer body 206 and an upper lip 210. Retainer 204 has a spring retainer cavity 208 therein dimensioned to receive spring 222, for frictional or sliding (slip) engagement of the spring 222 therewith as seen in FIG. 3B. Thus the general shape of retainer 204 is somewhat akin to a top hat, inverted, the body of the top hat being spring retainer body 206, which is inserted into retainer body cavity 207 of base 202 and may be butt welded along end surface 206*a* of retainer body 204 against the base of spring retainer cavity 207.

Backing plate assembly 201 is typically a unitary piece comprised of the base 202 and a multiplicity of retainers 204. Moreover, it is seen that backing plate assembly 201 has a multiplicity of O-rings 220 that are held in "sandwich" fashion by retainer 204. More specifically, as seen with respect to FIGS. 3A, 3B, and 3C, upper lip 210 will hold O-rings 220 in place in the O-ring cavity defined by rim 216 of base 202 and the upper lip 210 of retainer 204.

Prior art base plates typically do not have retainers fixedly engaged therewith. Instead, individual, loose seats are slidably engaged to a multiplicity of cylinder chambers and held in place by a separate flat, retainer backing plate. While prior art loose or free plugs do have O-rings for properly sealing, the tension of the compressed spring 222 engaged therewith will urge the individual prior art sealing plugs outward when prior art retainer plates were disengaged from the handle body. When prior art handle bodies are separated from prior art backing plates, as by removing fasteners, all the loose plugs (and springs) will typically tend to pop out or fall out of the chambers under the urging of the multiplicity of springs.

What Applicant provides is a unitary one-piece structure with a multiplicity of retainers, one for each cylinder chamber, each having a multiplicity of O-rings, on a base, which may be attached to or removed from handle body 214 as a fluid tight assembly, that is, a unitary assembly, which will retain the O-rings in place and engage the multiplicity of springs on the retainers.

A number of other features may be appreciated with reference to FIGS. 3A, 3B, and 3C. One is an alignment assembly 230 that assists in the alignment of backing plate assembly 201 to handle body 214. Proper alignment will center each retainer in its respective cylinder chamber. This is achieved, in part, by defining a nose or beveled portion 212 on the handle body assembly on end walls that define the cylinders. Nose or beveled portion 212 of handle body 214 is seen to fit against a seat 218 of base 202, which seat is, in part, located adjacent upstanding cylindrical rims 216 as seen in FIG. 3C. The effect of the upstanding walls of the nose, as well as the upstanding walls of rims 216, with some clearance provided therein, is to assist in the alignment and positional maintenance of backing plate assembly 201 with respect to handle body 214. Further, tapered nose or beveled portion 212 will help avoid pinching and rolling of O-rings 220, as backing plate assembly 201 is placed on handle body 214 or removed therefrom. Without the taper at nose or beveled portion 212, it can be seen that the backing plate, sliding past the O-ring during the assembly process, may cause pinching or rolling to occur. Typically, the bevel will provide sufficient clearance for the O ring and the upper lip 210. The unleveled cylinder diameter will compress the O ring, but provide clearance for the upper lip 210. Fasteners 219 are used to engage fastener holes 219*a* in the base and threadably engage the underside of the body of the handle.

FIGS. 4A-4H illustrate a novel nozzle assembly 300. Nozzle assembly 300 is capable of receiving soda, water and a multiplicity of different syrups from the handle body 214. The nozzle assembly will receive the pressurized fluids, selectively, by operation of the buttons on the handle and release the fluids at a removed end thereof.

A function of the nozzle assembly on the bar gun device is, generally, to provide for effective release under pressure with effective mixing occurring. A nozzle assembly should maintain initially in substantial isolation, one fluid from another, as well as the isolation of the soda water from the syrup, yet subsequently provide for effective mixing, for example, at a downstream end of the nozzle assembly, of the soda water and syrup.

Applicant provides a novel nozzle assembly 300 that will achieve this function and provide for effective mixing. This is achieved, in part, by diverting a pressurized, channel borne, centralized soda water stream for annulus delivery outside a sectored syrup bearing diffuser or spray head as set forth in more detail below.

Turning now to FIGS. 4A-4H, it is seen that nozzle assembly 300 is typically comprised of an exterior nozzle housing 302 engaged with a nozzle core 304. Nozzle core 304 is typically comprised of a multiplicity of bodies joined as by gluing or welding. Here, nozzle cap 306 engages diverter plate 308, which in turn receives syrup body 310, to which is engaged a diffuser or spray head 314.

Nozzle housing 302 is seen to be at least partially generally cylindrical and open at both ends, comprised of housing body 316 and upper rim 318. Upper rim 318 has inner walls 320, which include engagement boss 322. Furthermore, as seen in FIG. 4A, the interior of nozzle housing may have an inner waist 324, at which point the general cylindrical shape of the housing is seen to decrease slightly in diameter.

Nozzle cap 306 is seen to have a multiplicity of extended channel lips (for receiving syrup) 326 for engagement with channels 235 on the gun assembly handle portion 200 (see FIG. 1). Extended channel lips (syrup) 326 define a multiplicity of cylindrical channels 328 for carrying a multiplicity of different syrups and water. Nozzle cap 306 includes a top wall 330 for fitting flush against the handle body in flush fluid sealed relation, and may be glued to the handle.

Figure 4A:
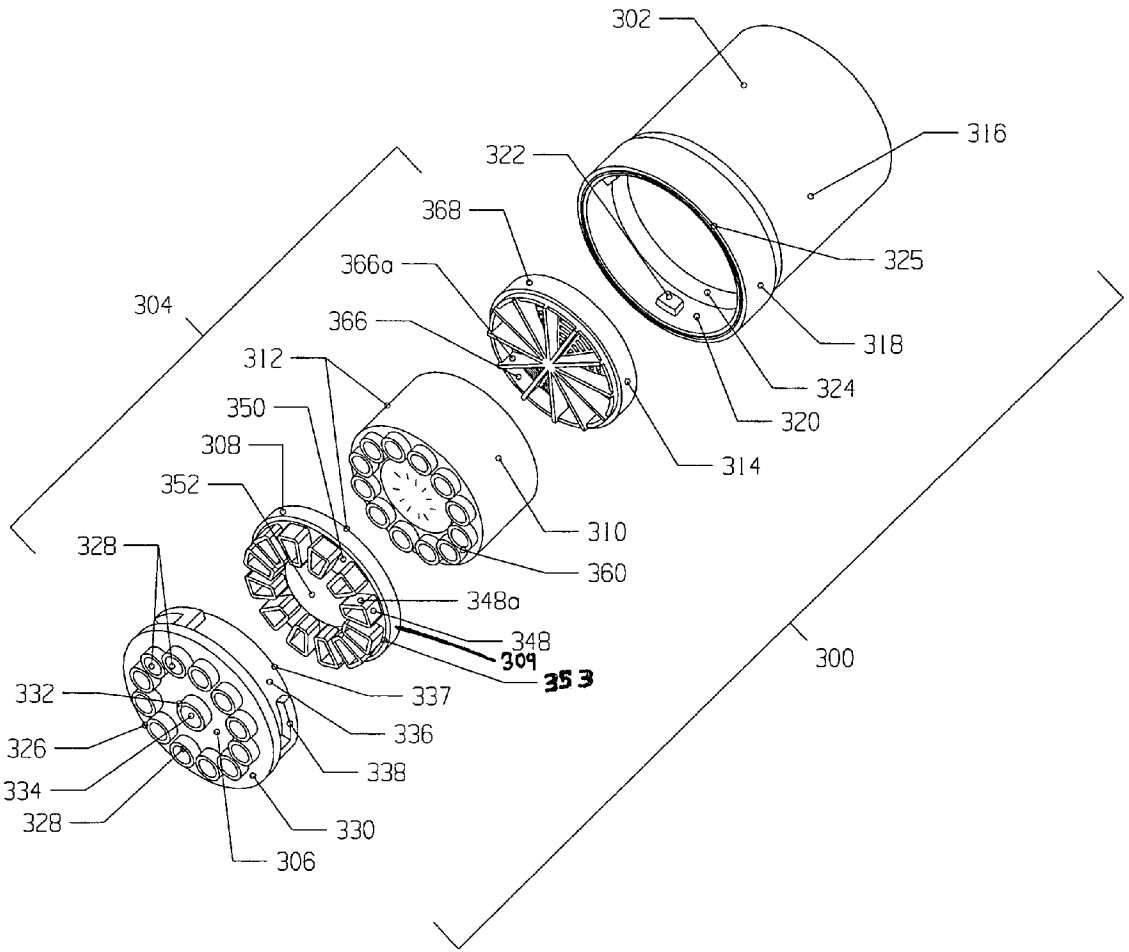
FIGS. 4A-4H provide various views of Applicant's novel nozzle assembly.
Figure 4B:
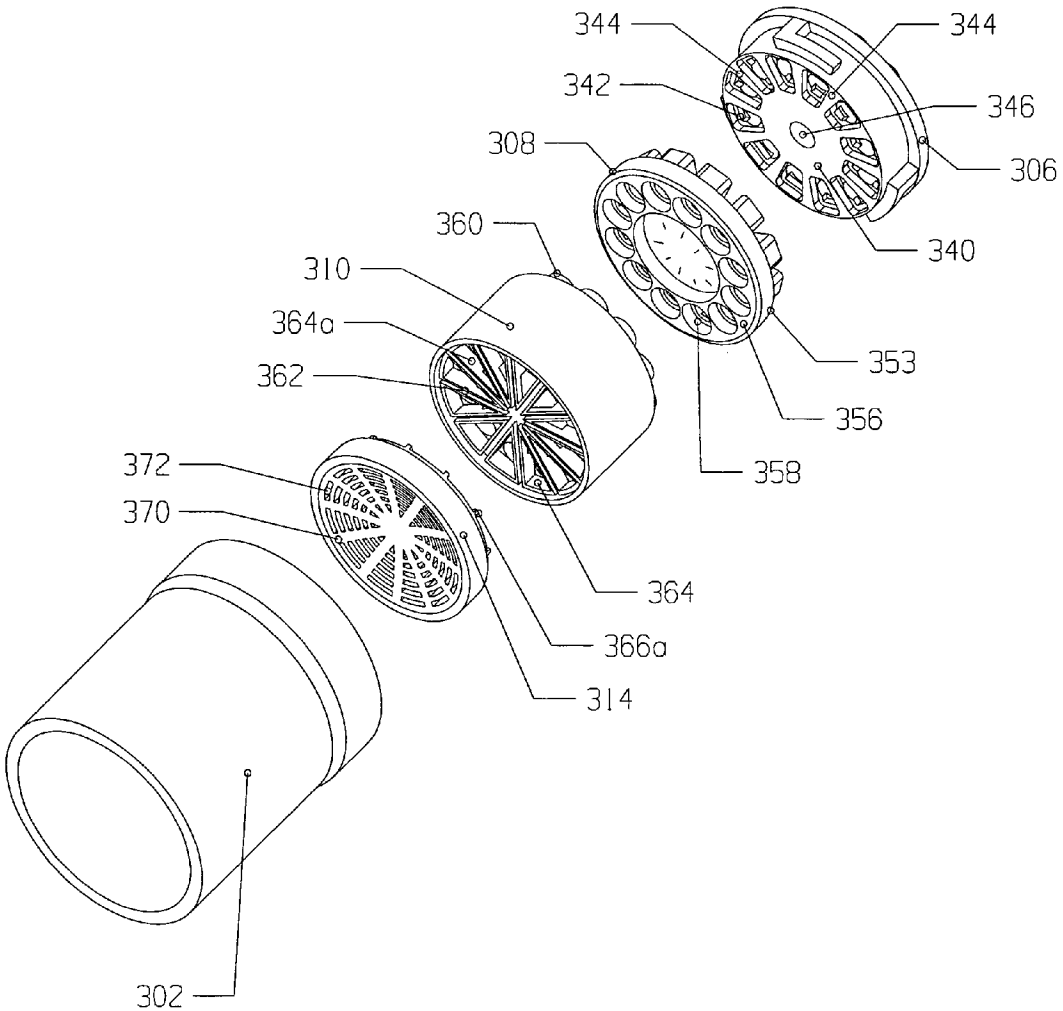
Figure 4H:
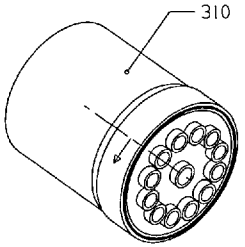
Figure 4G:
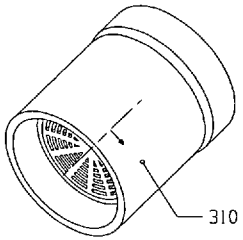
Figure 4E:
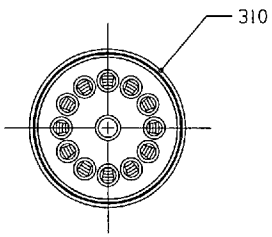
Figure 4D:
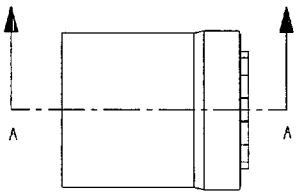
Figure 4F:
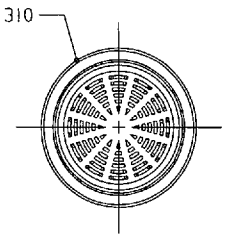

As can be seen in FIGS. 4A and 4B, extended channel lips 326 and cylindrical channels 328 are formed centrically on the cylindrical nozzle cap with an extended soda water channel lip 332 extending from the top wall 330, which extended soda water channel 332 defines a centrally located (that is, along the longitudinal axis of a nozzle assembly) soda water channel 334 through the nozzle cap, coming out at opening 346 (see FIG. 4B). Soda water channel 334 engages soda water channel 235*a* of main body (see FIG. 1) when the nozzle assembly 300 is engaged with the handle body 214. Side walls 336 of nozzle cap 306 include engagement members 338 for slideably, rotating engagement with engagement boss 322 of nozzle housing 302. This will hold the nozzle core within nozzle housing 302, but with separator assembly 312 spaced apart from the inner walls of nozzle housing 302.

Turning, in FIG. 4B, to the underside or bottom wall 340 of nozzle cap 306, it is seen that cylindrical channels 328 are now wedge-shaped channels 342 (with about the same cross-sectional area as cylindrical channels 328) separated by sidewalls 344. Soda water opening 346 represents the removed end of soda water channel 334.

Diverter plate 308 and syrup body 310 comprise a separator assembly 312, and will function as further set forth below. Diverter plate 308 has a multiplicity of wedge-shaped extension channels 348 arranged in a circle, each wedge-shaped extension channel 348 having sidewalls 348*a*. The upper lip of each wedge-shaped extension channels 348 will fit flush and integrally into and against walls defining wedge-shaped channels 342 on bottom wall 340 of nozzle cap 306 in a fluid sealing engagement. That is to say, channels 348 "plug in" to channels 342.

Soda water will pour out, under pressure, from soda water opening 346, diverter plate 308 will maintain the flow of syrup therethrough in channels 348 spaced apart and separate from other channels. Moreover, it can be seen that diverter plate 308 includes a multiplicity of radially directed diverter channels 350 between adjacent sidewalls 348*a*. Each diverter channel is constrained at the top by the bottom wall 340 of nozzle cap 306 and the top wall of diverter plate 308. Each diverter channel has a cross-sectional area. The sum of the areas of all the channels is about the area of soda water channel 334.

Diverter plate 308 includes diverter disk 352, which is typically dome or umbrella shaped (see FIG. 4C) (but flat in alternate embodiment). Diverter channels 350 run from the outer edge of diverter disk 352 and open out to gap 354 (see FIG. 4A) between the core and inner walls of nozzle housing 302. When soda water under pressure is released from soda water opening 346, it is typically projected against convex or raised diverter disk 352 and will spray outward, generally radially to be diverted, under pressure, through diverter channels 350. A gap 354 exists between lower rim 337 of the nozzle cap 306 and upper rim 353 of the diverter plate 308 of about 90/1000 inch. Soda water, under pressure, will move from gap 354 between upper rim 353 and lower rim 337 (see FIG. 4C) past rim 309, which provides back pressure to spread the fluid around the inner walls of the housing adjacent the rim to provide 360 degrees of inner wall coverage.

Turning to underside or bottom wall 356 of diverter plate 308, it is seen that the wedge-shaped channels 348 have now reverted to cylindrical shape defined by a multiplicity of cylindrical shaped syrup channels 358 of about the same cross-sectional area as channels 348.

Syrup body 310 will receive bottom wall 356 in sealing engagement between syrup channels 358 and a multiplicity of extended syrup channel lips 360 to maintain the isolated flow of syrup through syrup body 310. Syrup channel lips 360 are upper extensions of cylindrical syrup channels 362. However, the syrup body between the upper and lower ends will reform the geometry of a multiplicity of cylindrical syrup channels 362 (see FIG. 4B) by opening into a multiplicity of wedge-shaped or sectored syrup sectors 364, the sectors separated from one another by sidewalls 364*a* and of substantially the same area (see FIG. 4B) as one another. It can be appreciated with reference to FIGS. 4A-4C that the syrup is still maintained separate from other syrup channels, albeit the channels changing their cross-sectional shape to a sectioned or wedge shape.

Spray head 314 engages syrup body 310. Spray head 314 is seen to have a multiplicity of wedge-shaped or sectioned syrup chambers or channels 366, the channels separated by sidewalls 366*a* which radiate centrally in a pattern substantially identical to the pattern defined by sidewalls 364*a* of syrup body 310. Sidewalls 364*a* engage in a fluid sealing manner to sidewalls 366*a*. Inner walls of rim 368 further help define wedge-shaped syrup channels 366. Moreover, each of the wedge-shaped syrup chambers are seen to terminate at a slotted bottom wall 370, which has a multiplicity of slots 372 therein, which slots form a wedge-shaped or sectioned pattern, which pattern will define the initial flow of syrup ejected from slots 372. The slots are separated by slats. The total cross-sectional area of the slots of each channel 366 is slightly less than the cross-sectional area of syrup channel 360 to generate back pressure allowing acceleration of the syrup through the slots and slats resulting in a spray pattern.

As seen in FIGS. 4A and 4B, rim 309 provides some restriction or backflow against soda water flowing over the dome of diverter plate 308. Annulus 374 between the inner walls of housing 316 and outer walls of syrup body 310 may be in the range, approximately of 50 to 120/1000 inch (typically about 75/1000), and the annulus 376 between rim 309 and inner walls of housing 316 may be in the range of 20 to 60/1000 inch (typically about 45/1000). These are at flow rates of 1-2 ounces per second. Higher flow rates require larger widths.

Figure 4C:
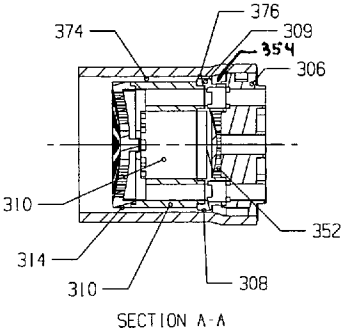

Turning to FIG. 4C, it is seen that the diameter of separator assembly 312 and head 314 is less than the interior diameter of nozzle housing 302, such that soda water, ejected under pressure, out diverter channels 350 and through gap 354 will enter annulus 376 and annulus 374. Annulus 374 is the space between the inner diameter of the subassembly defined by the combination of elements 310, and 314, and the inner walls of nozzle housing 302 below rim 309. A tight seal of nozzle cap 306 against nozzle housing 302 will help maintain pressure directing soda water down the annulus to spray head 314. The four pieces 306, 308, 310, and 314 of core 304 maintain fluid tight seals of their respective syrup channels in body to body engagement, delivering syrup to spray head 314. Twelve sectors are seen in spray head 314 corresponding to twelve channels 328 in nozzle cap 306.

FIGS. 5A-5I illustrate a preferred embodiment of Applicants' nozzle assembly 400, comprised of a nozzle core 404 and a nozzle housing 402. In common with the embodiment illustrated in FIGS. 4A-4H, nozzle assembly 400 provides for a number of advantages. First, all of Applicants' nozzle assemblies disclosed herein will provide for full coverage of the soda water on the inner walls of the outer housing as the soda water descends below the diverter plate. More specifically, the nozzle assemblies disclosed herein provide for soda water coming out of the multiplicity of diverter channels to substantially completely cover inner walls of the outer housing as the soda water descends below the diverter plate. Thus, the nozzle assembly will ensure that the coverage of the soda water on the inner walls of the nozzle as it descends below the diverter plate is complete.

The embodiments of all of the nozzles set forth herein also achieve fluid tight coupling of the nozzle core and outer housing to the handle to the handle body, as well as coupling that will resist twisting and breakage.

Figure 5A:
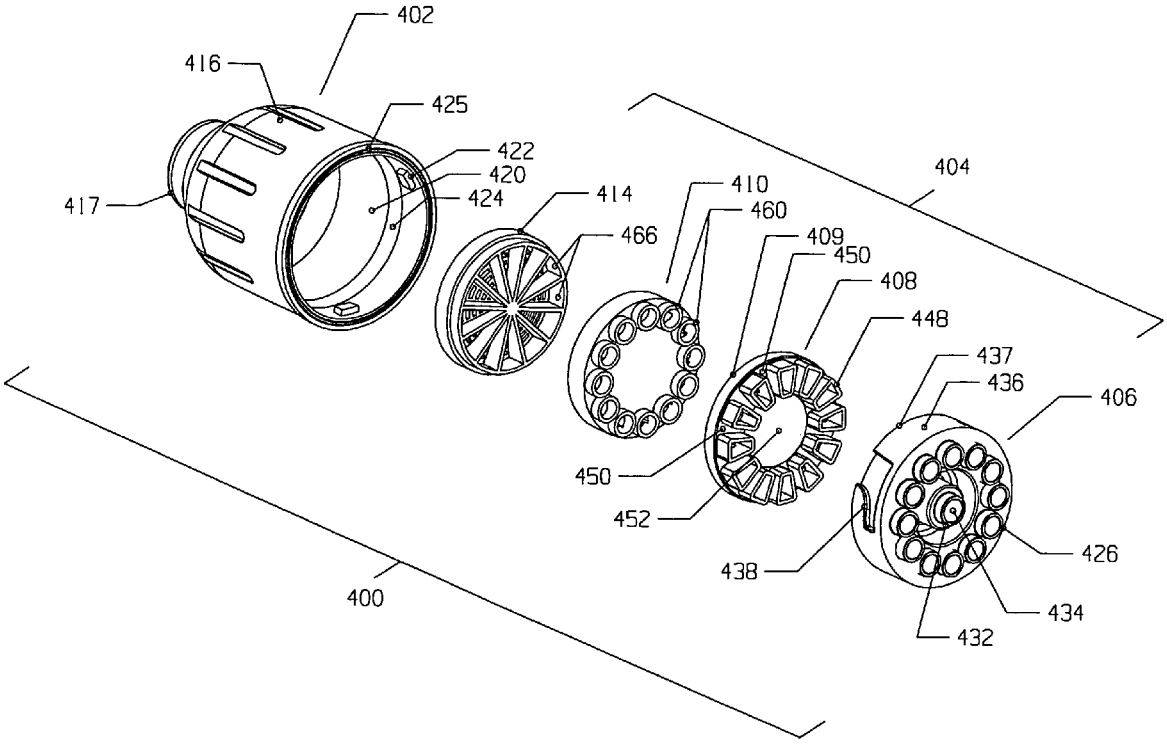
FIGS. 5A and 5B illustrate an exploded view of a second and third embodiment of Applicants' nozzle assembly.
Figure 5B:
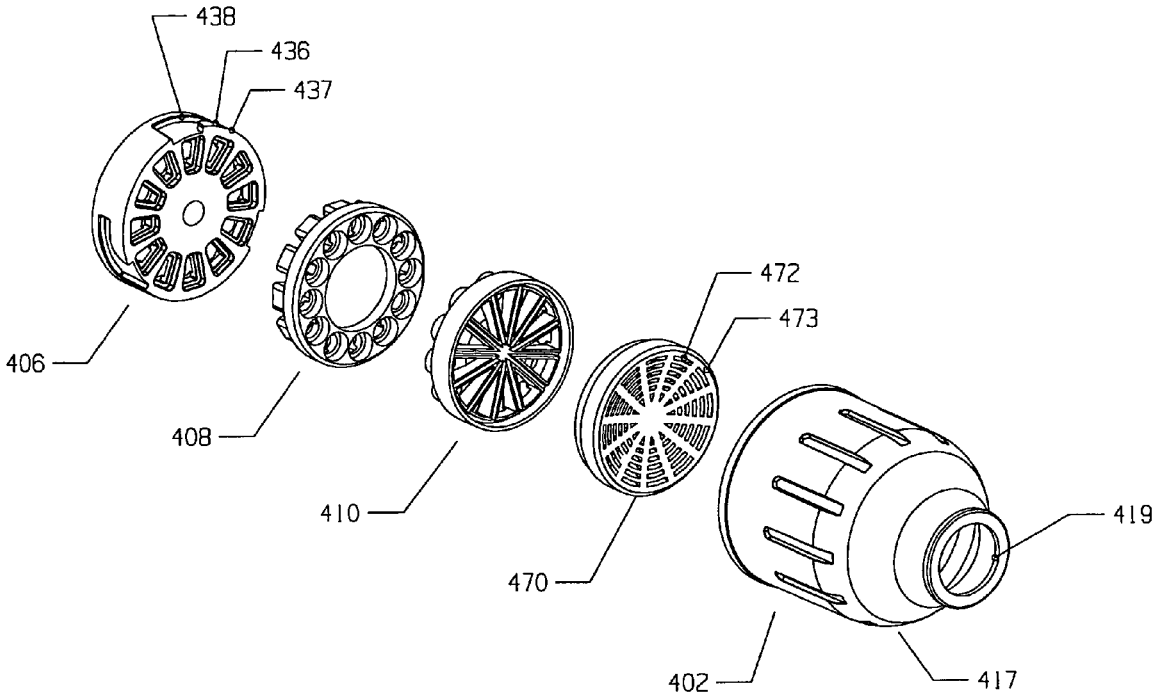
Figure 5C:
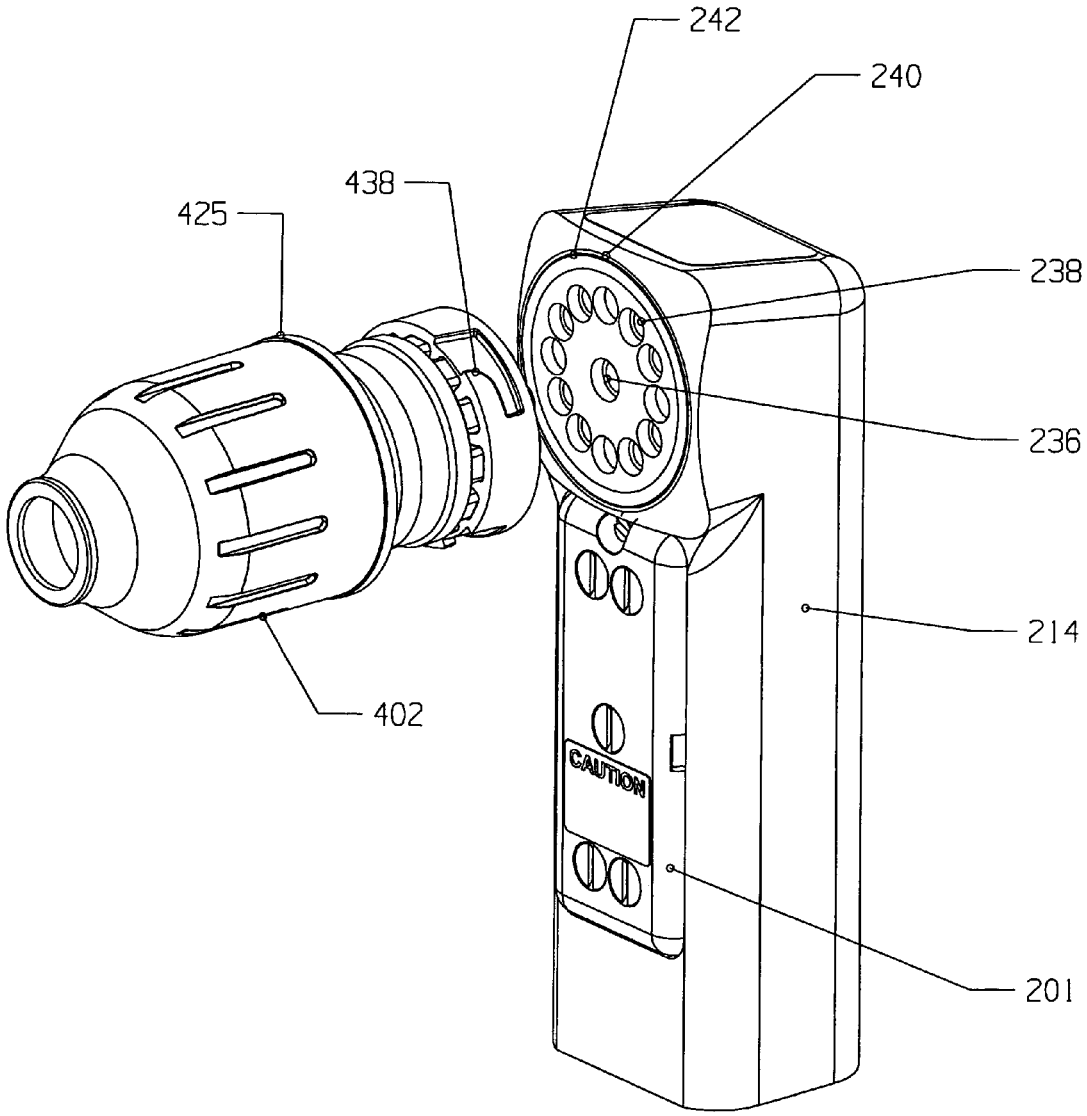
FIG. 5C is a perspective view of the manner in which Applicants' novel nozzle assembly, comprising a nozzle core and a nozzle housing engage the handle. More specifically.
Figure 5I:
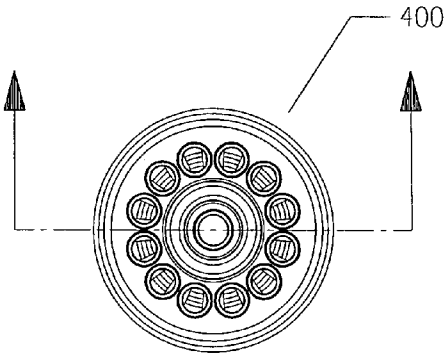
FIG. 5I is a top elevational view of a preferred embodiment of the nozzle assembly.

Turning now to FIGS. 5A, 5B, and 5C, it seen that nozzle cap 406 includes syrup channel lips 426 and soda channel lip 432 as set forth in the earlier embodiment. Likewise, it is seen how these lips will engage the recesses in the handle body 214 (FIG. 5C). Namely, soda water recess 236 will engage soda channel lip 432 and syrup channel lips 426 will engage the multiplicity of syrup recesses 238. Prior to engagement of nozzle core to handle body 314, the four elements thereof 406/408/410/414 or 306/308/310/314 would be glued or welded together with a solvent. The nozzle core 304/404 is then glued with an appropriate solvent or adhesive to the body with the nozzle lips (syrup and soda water) plugged into the handle recesses. This will ensure that it is more difficult to break or twist off the nozzle core with respect to the body because of the positive engagement made between the lips and the counter-bored recesses, rather stronger than a flush nozzle core end to handle relationship as known in the prior art.

Another function of the nozzle cap, beyond joinder to the handle body, is to provide engagement of the nozzle core adjacent the nozzle housing. Nozzle cap 406 is seen to be similarly dimensioned to nozzle cap 306. Side walls 436 of nozzle cap 406 extend all the way down to lower rim 437. This relieves some of the upflow tendency of soda water coming through the diverter channels and striking the inner walls of nozzle housing 402.

Diverter plate 408 functions in the same manner as diverter plate 308, namely, to direct syrup through a multiplicity of wedge-shaped extensions 448 to carry syrup therethrough and to provide a diverter disc 452 (typically dome or umbrella shaped) to direct soda water through a multiplicity of diverter channels 450. That is to say, the diverter plates 308/408 divert soda water from a constrained channel flow in the nozzle cap, to a multiple outward channeled flow against inner walls of the nozzle housing. Syrup body 410, having a multiplicity of syrup channel lips 460, provides the same function as syrup body 310, though the dimensions are seen to be shorter along the longitudinal axis of nozzle core 404. Spray head 414 is sealed (fluid tight) to the underside of syrup body 410 and receives syrup in a multiplicity of wedge-shaped syrup channels 466.

Nozzle housing 402 is seen to include inner walls 420 and inner waist 424 showing a small decrease in the inner diameter of the nozzle housing. It is also seen to have an upper perimeter 425 which is dimensioned for receipt against and/or into channel 240 of the handle body 214. That is to say, with nozzle core 404 in place on handle, nozzle housing 402 is slid over the core, engagement bosses 422 engaged with engagement members 438, and a few degrees of twist will seal upper perimeter 425 against the O-ring or flat seal 242 of channel 240. This will provide a releasable, substantially fluid tight seal between nozzle housing 402 and handle body 214. Bosses 422 engage member 438 such that upper perimeter 425 seats with and typically slightly presses into an elastomeric O-ring or face seal 242 (see FIG. 5C).

Nozzle housing 402 is seen to have a housing body 416 and a nose portion 417. It is seen that nose portion 417 defines a portion of the lower end of nozzle housing 402, wherein the diameter of the housing walls decrease. A nose opening 419 is provided with an opening that is less than the diameter of spray head 414. It has been found that this nose portion will provide more effective prevention of carryover from one flavor into the other, and provide for a full column of mix coming out of the opening.

In both embodiments, a multiplicity of diverter channels is provided, here twelve, for the soda water, but typically more than six, to help provide substantially complete coverage around the inner walls of nozzle housing 402 as the soda water descends toward the removed end thereof under pressure. Moreover, nose portion 417 tends to accelerate the flow of the sheet of soda water as it undergoes directional change between the body and the nose portion.

Figure 5D:
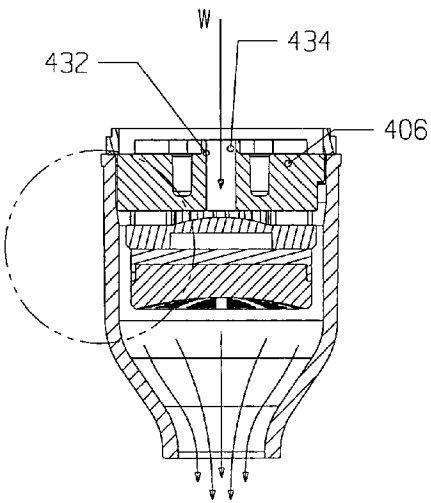
FIGS. 5D and 5E illustrate a cross-sectional elevational view of the second and third embodiment of Applicants' nozzle, which views illustrate the manner in which soda water flows through diverter channels in an annulus between the core and the inner walls of the nozzle and out the nose of the housing.
Figure 5E:
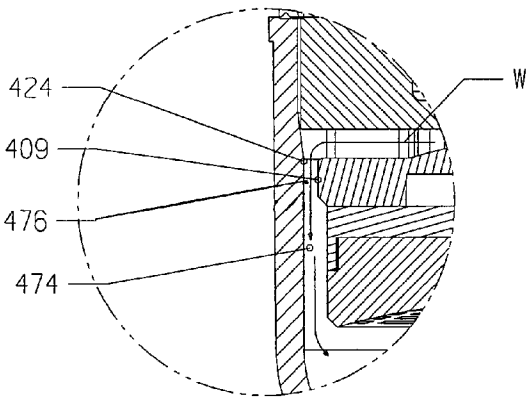

Reference to FIGS. 5D, 5E, 5F, and 5G will assist in an explanation of the structure involved with Applicants' controlled pressure release, which, among other functions, helps prevent too much foaming and helps ensure full soda water coverage. Turning now to FIGS. 5D and 5E, sections are provided which help illustrate the flow of pressurized soda water through the nozzle assembly 400 in a flow controlled manner. First, it is to be noted that soda water is designated W and is seen to flow through soda water channel lip 432 into the soda channel of the nozzle cap 406. However, when leaving nozzle cap 406, there is initially some pressure release as the soda water W is no longer constrained by the outer walls of the soda water channel of nozzle cap 406. Diverter plate 408 which typically has a convex curve shape (with the apex beneath soda water channel 434 of cap 406) with respect to the soda water W entering into the space between nozzle cap 406 and diverter plate 408 will be urged outward, in part under the impetus of pressure and in part from the convex curve of the diverter plate, into diverter channels 450 located as they are between wedge shaped extensions 448 (see FIG. 5A). The multiplicity of small diverter channels along with the limited space between the nozzle cap and diverter plate will somewhat constrain release of pressure that occurs when the soda water leaves the soda water channel 434 of nozzle cap 406. Following the soda water arrows W in FIGS. 5D and 5E, it is seen that the path of the water is downward past annulus 476 between the inner walls of nozzle housing 402 and rim 409 of diverter plate 408. The rim 409 will further provide flow restriction that will help prevent too rapid a decompression of the soda water and subsequent foaming.

It is seen that past rim 409, which helps ensure a full coverage or "spread" of soda water over the entire surface of the inside of the nozzle housing adjacent the rim, water flows into an annulus 474 slightly larger than that of annulus 476 (that is, the annulus between rim 409 and the inner walls of nozzle housing 409). Annulus 474 is tight enough to avoid an overfoaming situation generated by too sudden or too great of a pressure drop. Likewise, annulus 474 is tight enough to help ensure full coverage, a 360° spread around inner surface of the walls of the nozzle.

Figure 5H:
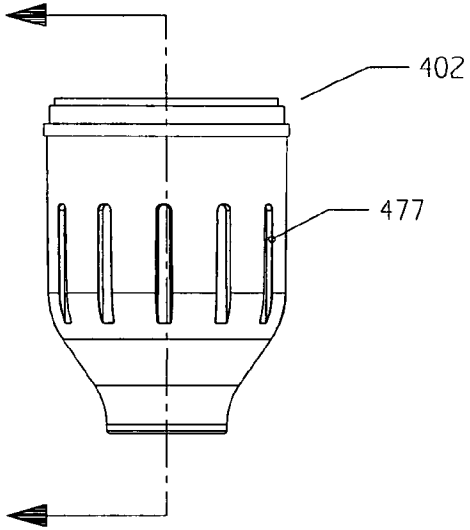
FIG. 5H is a view of an alternate preferred embodiment of Applicants' nozzle, which contains ribs on an external surface thereof.
Figure 5G:
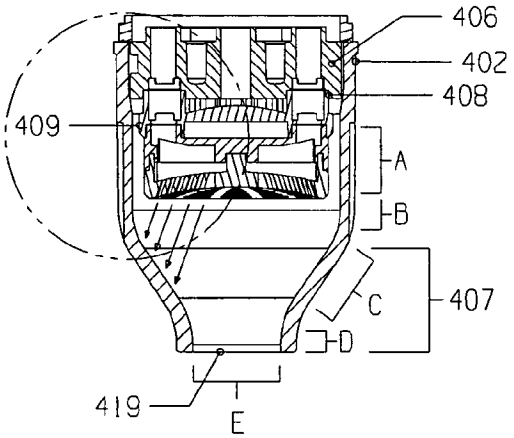
FIGS. 5F and 5G illustrate the cross-sectional views of FIGS. 5D and 5E, except showing the section through which the syrup flow channels may be seen and showing the manner in which the syrup is ejected from a slatted spray head to join the water in the inner portion of the nose of the nozzle housing.
Figure 5F:
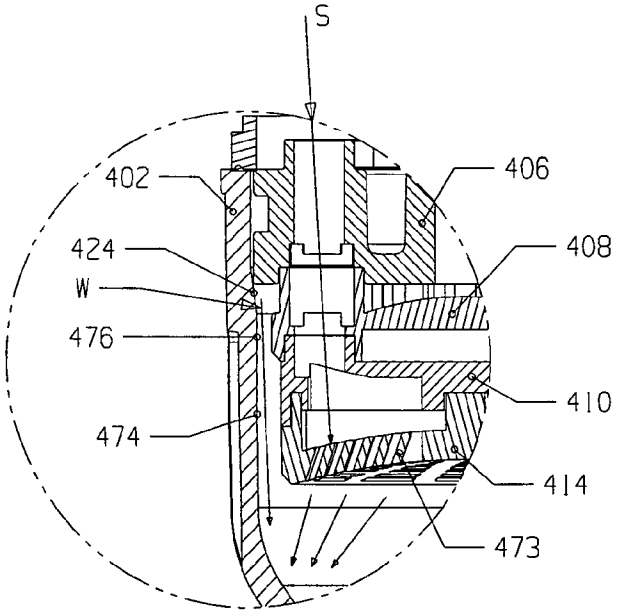

Continuing the flow of the soda water through annulus 474 is seen that a point is reached where the annulus ends. That is adjacent the removed end of the spray head 414 as best seen in FIG. 5F or 5G. It is at this point that soda water is substantially free of the effective non-gravitational upstream pressure and additional $CO_2$ may be released as a consequence thereof. Further, it is seen, especially with FIG. 5F, which shows both the flow of soda water W and syrup S, that the use of angled slats 473 in spray head 414 will direct the syrup, under pressure towards the inner walls of the nose of the nozzle housing.

As best seen in FIG. 5F, three things are typically happening to the soda water (with substantially full coverage of the inner walls of the housing 402) in a short period after it passes through the removed end of annulus 474. First, there is pressure release which will encourage some release of $CO_2$ and subsequent foaming. Second, there is an acceleration of the water when it strikes the nose portion and undergoes a change of direction (nose's inner walls are of decreasing diameter). Third, it is being struck by syrup directed in a spray pattern to a point below where the annulus ends and about or below where the acceleration of the water begins. It is further noted that the slats are directed so as to cover inwardly directed walls of the nose generally from top to bottom in the manner of the arrows shown in FIGS. 5F and 5G. In other words, the syrup is slot directed, under pressure, against the inner walls of the nose. Thus, syrup and soda water mixing occurs along the walls of the nose and along a cone shaped area defined by inward dimensioned walls of the nose.

The various zones of soda water flow may be appreciated with reference to FIG. 5G. Zone A is the flow below the rim in which soda water is cascading down from annulus 476, but still constrained somewhat in annulus 474. Zone B illustrates the zone in which the soda water continues its flow down inner walls, but is no longer subject to pressure constraints of annulus 474 and some foaming starts or increases. In Zone C, the soda water accelerates as the nose diameter diminishes and the soda water is being struck by the syrup under pressure from the angled slats 473 and mixing and foaming is occurring. In Zone D, the nose terminates at opening 415 with a slight outward curved lip which helps funnel the soda/syrup mix into a column shape.

In some prior art nozzles, electronic control allows a slight delay in the delivery of syrup and air mix of the syrup and soda water is provided. In the present device, electronics are not needed and air mix is replaced with mixing against and along the inner walls of the nose of a nozzle assembly, which nose assembly is fully coated along the cone shaped interior thereof with soda water and thus avoids flavor carryover.

Applicants help avoid flavor carryover by providing for a full "wash" of the cylindrical and cone-shaped inner walls of the housing after the syrup flow ceases. That is to say, in part, because the soda water flow is coming from up higher on the inside of the nozzle, after the handle button is released to cease fluid delivery to the nozzle, the soda water will continue to flow down the inner nozzle for a short distance, while there is little or no more syrup coming out of the spray head. This helps create a good wash of syrup off the inner walls of the nose. Second, the slats are directed so that, when pressurization occurs in the nozzle, the syrup is directed in a spray pattern, not to the nose opening (as is typical of prior art), but over to the sidewalls in the pattern indicated. Thus, there is no syrup dripping out of the nose unless it is combined with soda water. Third, because the slats are fairly close together, typically about 30-35/1000 of an inch (range about 15-60/1000), there will be little or no dripping (capillary action between adjacent slats will prevent the drip of syrup).

Some of the dimensions in structure which help provide the novel achievements of Applicants' novel nozzle assembly include the wedge shaped extensions that provide diverter channels and which have an area corresponding to typically about 156/1000 inch diameter. In a preferred embodiment, there are twelve syrup channels and an annulus 476 of approximately 20-60/1000 inch width (typically about 45/1000). Annulus 474 may be provided with the width of about 50-120/1000 inch (typically about 75/1000). Typical nose width measured interior at the highest point is typically about 545/1000 inch and at its narrowest point (adjacent nose opening 419) about 200/1000 inch. These are typical for flow rates of approximately 1-2 oz/sec.

Multiple wedge shaped sectors 464 are provided, typically twelve. In the preferred embodiment, there are six to twelve syrup channels and a single soda water channel flowing through the nozzle cap into the diverter plate, subsequently through six to twelve diverter channels and cascading down the inner walls adjacent rim 409 to completely coat the inside of the walls of the nozzle housing. FIG. 5H shows that ribs 477 may be provided on the outer walls of nozzle housing 402 for assisting a grip on the nozzle (for example, when removing with a damp hand).

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A bar gun assembly for receiving a multiplicity of fluid carrying tubes carrying a multiplicity of fluids therein, the bar gun assembly comprising:

a handle having a handle body, and having a multiplicity of ports and a multiplicity of fluid channels therein, and having a multiplicity of cylindrical fluid chambers having fluid chamber openings;

a supply line connector assembly for engaging the fluid carrying tubes and the handle body;

a backing plate assembly for engaging the openings in the fluid chambers; and a nozzle assembly for engaging at least some of the fluid channels of the handle;

wherein the handle body of the handle includes ports; and the supply line connector assembly includes a connector plate for engaging the handle body and the multiplicity of fluid carrying tubes to engage the fluid carrying tubes to the ports in the handle body and a heel, the heel adapted to removably engage the connector plate and the handle body such that the heel may be removed from the connector plate and the handle body while the connector plate maintains secure engagement of the fluid lines to the handle body;

wherein the supply line connector assembly includes a multiplicity of nipple assemblies for engaging the removed ends of the fluid carrying tubes, the connector plate, and the ports, the nipple assemblies including nipples and ferrules for engaging engage the ports, the connector plate, and walls to engage the tube, the connector plate to sandwich the ferrule and nipple in the port when the connector plate is engaged to the handle.

2. The bar gun assembly of claim 1, wherein the connector plate of the supply line connector assembly includes a multiplicity of holes dimensioned for receipt of the fluid carrying tubes therethrough and wherein the multiplicity of holes are smaller in diameter than the outer diameter of the ferrule.

3. The bar gun assembly of claim 1, wherein the nipples of the multiplicity of nipple assemblies of the supply line connector assembly include walls dimensioned to secure at least a pair of O rings, the O rings adapted to engage the walls of the ports in fluid sealing relation.

4. The bar gun assembly of claim 1, wherein the heel of the supply line connector assembly has a single opening dimensioned for receiving all the fluid carrying tubes therethrough, and a multiplicity of fastener openings therethrough, at least some of the multiplicity of fastener openings adapted to receive both a first fastener and a second fastener, the first fastener for engaging the connector plate to the handle and having a fastener head for receipt into the heel, the second fastener for receipt into the head of the first fastener and adapted to hold the heel to the first fastener.

5. A bar gun assembly for receiving a multiplicity of fluid carrying tubes carrying a multiplicity of fluids therein, the bar gun assembly comprising:

a handle having a handle body, and having a multiplicity of ports and a multiplicity of fluid channels therein, and having a multiplicity of cylindrical fluid chambers having fluid chamber openings;

a supply line connector assembly for engaging the fluid carrying tubes and the handle body;

a backing plate assembly for engaging the openings in the fluid chambers; and a nozzle assembly for engaging at least some of the fluid channels of the handle;

wherein the supply line connector assembly includes a connector plate, a multiplicity of ferrules, and a multiplicity of nipples, and wherein the nipples and ferrules are adapted to compressively hold the ends of the supply lines therebetween and wherein the walls of the ferrules are adapted to engage the walls of the connector plate and the walls of the nipples are adapted to engage the ports of the handle body to limit movement of the ferrules between the connector plate and the handle.

6. The bar gun assembly of claim 5, wherein the nipples have an inner diameter that is close to the inner diameter of the supply lines.

* * * * *